US006902007B1

(12) United States Patent
Orr et al.

(10) Patent No.: US 6,902,007 B1
(45) Date of Patent: Jun. 7, 2005

(54) BLOW OUT PREVENTER TRANSPORTATION

(75) Inventors: Alan Orr, Tulsa, OK (US); George Dotson, Tulsa, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 90 days.

(21) Appl. No.: 10/402,667

(22) Filed: Mar. 28, 2003

(51) Int. Cl.[7] ..... E21B 19/00
(52) U.S. Cl. ..... 166/379; 166/79.1; 166/85.4
(58) Field of Search ..... 166/79.1, 85.4, 166/377–379, 383

(56) References Cited

U.S. PATENT DOCUMENTS

| | | | | |
|---|---|---|---|---|
| 1,758,453 A | | 5/1930 | Mays | 166/79.1 |
| 3,498,375 A | | 3/1970 | McEwen et al. | 166/79.1 |
| 4,230,190 A | | 10/1980 | Guinn et al. | 175/5 |
| 4,359,089 A | | 11/1982 | Strate et al. | 166/79.1 |
| 5,121,793 A | | 6/1992 | Busch et al. | 166/79.1 |
| 5,407,302 A | | 4/1995 | Springett et al. | 405/196 |
| 6,085,851 A | * | 7/2000 | Scott et al. | 175/7 |
| 6,161,358 A | | 12/2000 | Mochizuki et al. | 52/651.05 |
| 6,234,253 B1 | | 5/2001 | Dallas | 166/377 |

* cited by examiner

*Primary Examiner*—Zakiya Walker
(74) *Attorney, Agent, or Firm*—Head, Johnson & Kachigian

(57) ABSTRACT

A blowout preventer transportation and installation system. The system includes a transportation skid assembly having a transport carriage to raise the blowout preventer between a horizontal transport position and a vertical position. The transport carriage on the skid assembly moves the blowout preventer with respect to the skid assembly. A boomer assembly having a crane mounted on a carriage frame on a boomer assembly frame raises and lowers the blowout preventer. The carriage frame moves with respect to the boomer assembly frame to move the blowout preventer over a wellhead. A control line support assembly supports hose lines extending between the blowout preventer and a hydraulic power unit.

14 Claims, 7 Drawing Sheets

BLOW OUT PREVENTER TRANSPORTATION

BACKGROUND OF THE INVENTION

1 Field of the Invention

The present invention is directed to an apparatus and a method to transport and install a blowout preventer for a drilling or workover rig. In particular, the present invention is directed to a blowout preventer transportation and installation system to transport a blowout preventer between drilling locations, raise the blowout preventer from a horizontal transport position to a vertical position, and hoist and translate the blowout preventer to a wellhead while connected to a hydraulic power and control unit.

2. Prior Art

From time to time in a drilling or workover rig, it will be necessary to move the rig from one location to another. In existing practice, the components of the rig will be disassembled, transported and then reassembled at the new location. Oftentimes, a blowout preventer will be employed with the rig, which is a series of valves or valving arrangements to prevent gas or oil under pressure from uncontrollably blowing or escaping out. Blowout preventers can extend 15 to 20 feet high and weigh many tons.

It is routine practice to detach and disassemble the blowout preventer, transport in multiple pieces, and then reassemble and reattach the blowout preventer at the new location. This is extremely time consuming and labor intensive.

While derricks or cranes could be utilized to move the blowout preventer, this is often difficult because of other equipment at the rig site. Specifically, there is often limited clearance between decks where the blowout preventer is located.

In the past, various carts have also been utilized to move blowout preventers. By way of example, Strate et al. (U.S. Pat. No. 4,359,089) discloses a skid and carrier for a blowout preventer which includes a skid for sliding along the ground and a cradle for the blowout preventer.

It would be advantageous to provide a modular system wherein each component of the system could be loaded for transport to the drilling or work over rig site and utilized to install and remove the blowout preventer.

The blowout preventer is often connected by lines or hoses to a hydraulic unit which supplies hydraulic power in order to operate and control the blowout preventer.

In the normal known systems, the blowout preventer is brought into place over the wellhead and the hoses are thereafter connected. Conversely, the hoses will be disconnected prior to moving the blowout preventer from its position on the wellhead.

It would be advantageous to provide a system where the hydraulic hoses could be connected to the blowout preventer prior to moving the blowout preventer into place over the wellhead for ease of installation and for testing prior to moving over the wellhead.

SUMMARY OF THE INVENTION

The present invention provides an apparatus and a method to transport and install a blowout preventer for a drilling or workover rig. A blowout preventer transport skid assembly is used to move a blowout preventer to and from a well head at a well site. The transport skid assembly and accompanying blowout preventer can be moved onto a transportation vehicle and thereby moved from one site to another.

The transport skid assembly includes a frame having a pair of parallel I-beams and a series of connecting cross braces. A transport carriage has a set of extending rollers that move the transport carriage with respect to the skid assembly in the same plane as the skid assembly.

A drive assembly has a rotating drive shaft which rotate a gear wheel in order to engage a rack mounted on the frame. Engagement of the drive assembly with the rack will move the transport carriage in relation to the transport skid assembly.

The transport carriage includes a blowout preventer cradle having a pair of posts that move radially with respect to the transport carriage and the skid assembly. The posts are moved with respect to the transport carriage by a pair of hydraulic cylinders. The cradle and the posts pivot about a pair of pivot pins. Actuation and extension of the hydraulic cylinders results in radial movement of the cradle. When the hydraulic cylinders are fully extended the blowout preventer will be in a vertical, fully upright position parallel to the wellhead.

Once the blowout preventer is moved to the vertical position, various hydraulic hoses may be connected to the blowout preventer so that the blowout preventer is connected to the hydraulic power and control unit. Alternatively, the hoses can be connected prior to the blowout preventer being raised from the horizontal position. Thereafter, the transport carriage can be moved with respect to the transport skid assembly so that the upright blowout preventer is in line with the well center line beneath the driller's cabin.

Thereafter, the blowout preventer will be moved from the transportation skid assembly into position over the wellhead.

A boomer assembly includes a frame having a pair of I-beams parallel to each other. A carriage frame moves along the I-beams of the frame and includes a series of rollers that engage the I-beams. The carriage frame includes a drive assembly that engages a rack on the frame in order to move the carriage in the same plane as the frame. Mounted on the carriage frame is the crane or boom having an extending wireline which is capable of lifting or lowering the blowout preventer. A cylinder or pair of cylinders extend to move the boom to the desired height. The carriage frame of the boomer is moved so that the boom is above the blowout preventer. Once the blowout preventer has been connected to the boom, the blowout preventer is lifted. Thereafter, the carriage frame is moved with respect to the skid assembly so that the blowout preventer will be brought over the wellhead. Finally, the blowout preventer will be lowered onto the wellhead. Thereafter, the boom and the carriage frame can be retracted.

In order to remove the blowout preventer from the wellhead and transport the blowout preventer to a new location, the reverse procedure is performed.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
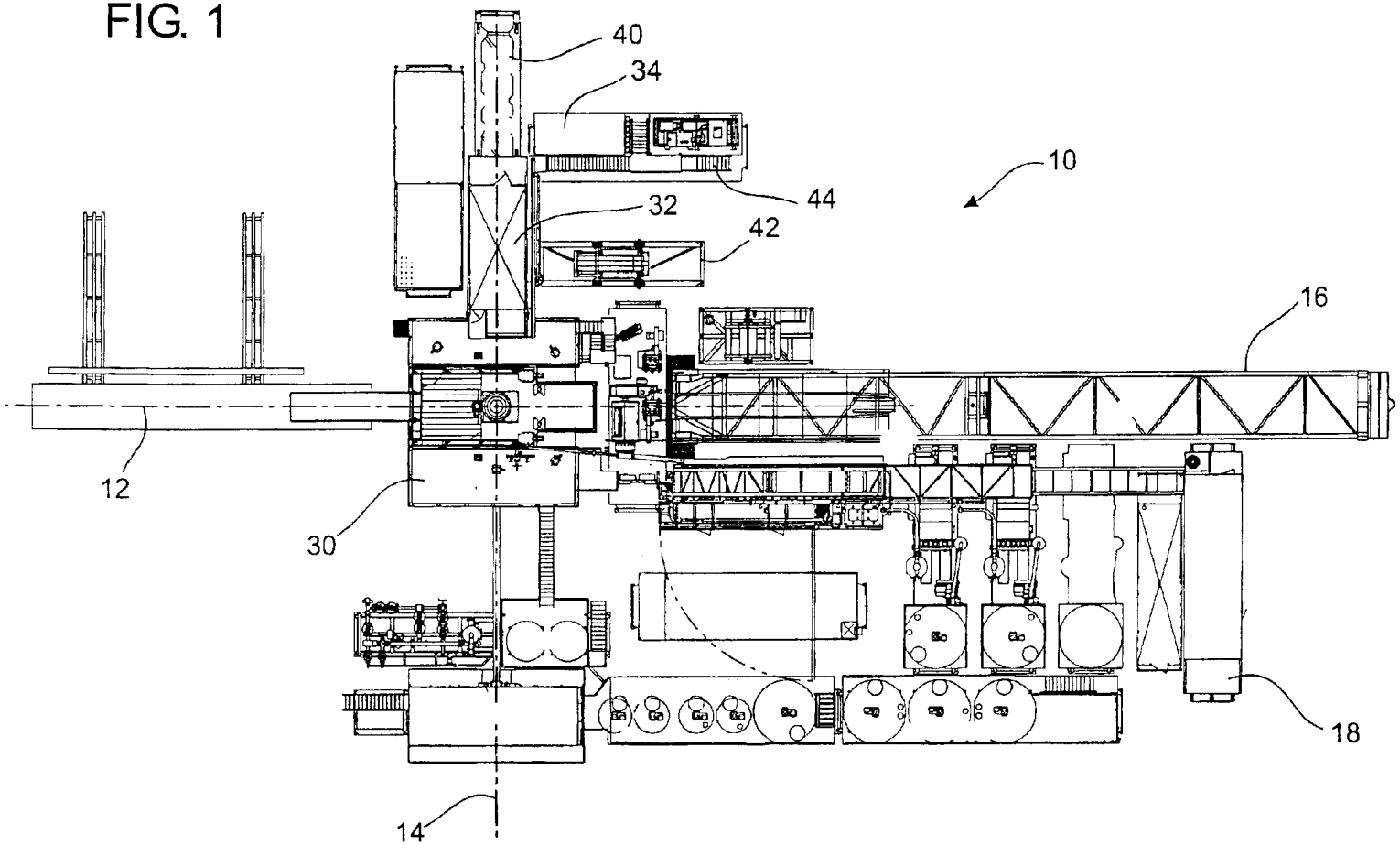
FIG. 1 illustrates a diagrammatic overview of the drilling rig layout incorporating the blowout preventer transportation and installation system of the present invention.

FIG. 1 illustrates a diagrammatic overview of a drilling rig layout 10 showing various components and elements located at a drilling rig site. In FIG. 1, a mast 16 is shown in a horizontal position prior to being raised to the vertical use position. Dashed lines 12 and 14 intersect to illustrate the location of the wellhead at the center line of the well. The mast 16 in the horizontal position has been transported to the drilling location prior to being raised in the vertical position for use. A variable frequency drive house 18 mounted on a skid distributes electrical power to the drilling rig site.

A raised drill floor 30 surrounds the well. A driller's cabin 32 is supported on legs so that it is at the raised drilling floor level. A hydraulic power and control unit 34 is mounted on a skid and supplies hydraulic power to the rig and the various components thereof.

A blowout preventer transport skid assembly 42 will be parallel to dashed line 12 and perpendicular to dashed line 14.

The present invention includes a blowout preventer boomer assembly 40, a blowout preventer transportation skid 42, and a control line support assembly 44, each of which will be described in detail herein.

Figure 2:
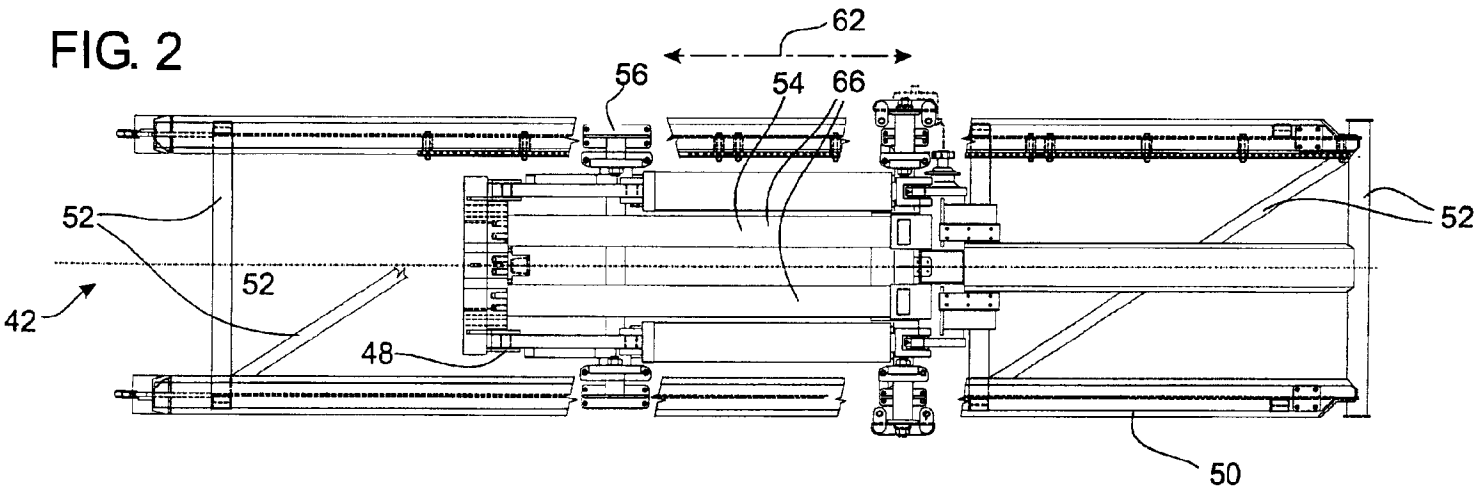
FIG. 2 illustrates a top view of a blowout preventer transportation skid assembly of the transportation and installation system of the present invention.
Figure 3:
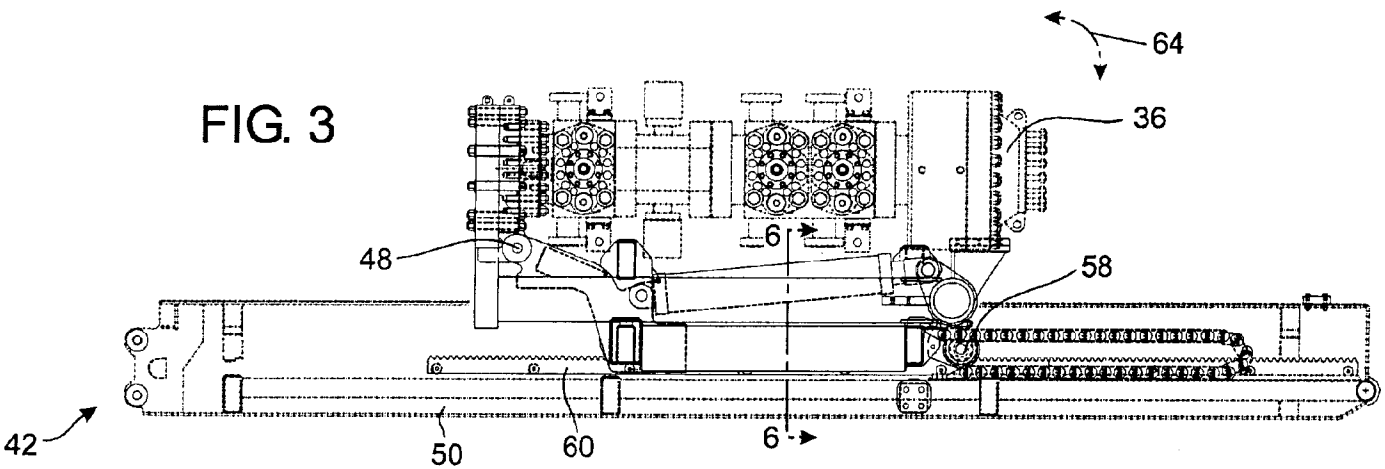
FIG. 3 illustrates a side view of a blowout preventer transportation skid assembly of the transportation and installation system of the present invention.

FIG. 2 illustrates a top view, while FIG. 3 illustrates a side view, of the blowout preventer transport skid assembly 42. The blowout preventer transport skid assembly 42 is used to move a blowout preventer 36 (seen in FIG. 3) to and from a rig site and the boomer assembly.

The blowout preventer transport skid assembly 42 is shown in top view in FIG. 2 with portions cut away for clarity. The skid can be moved up a ramp such as on a ramp on a transport vehicle. Accordingly, the transport skid assembly 42 and the accompanying blowout preventer can be moved onto a transportation vehicle and moved from site to site.

The transport skid assembly 42 includes a frame 50 having a pair of parallel I-beams and a series of connecting cross braces 52.

A transport carriage 54 has a set of extending rollers that move the transport carriage 54 with respect to the skid assembly 42 in the same or parallel plane as the skid assembly.

A drive assembly 58 has a rotating drive shaft which rotates a gear wheel which engages a rack 60 mounted on the frame 50. Engagement of the drive assembly 58 with the rack 60 will move the transport carriage 54 in relation to the skid assembly. Power to the drive assembly may be supplied by hoses within a drag chain. Accordingly, the blow out preventer 36 can be moved in the directions shown by arrow 62 in FIG. 2.

Figure 6:
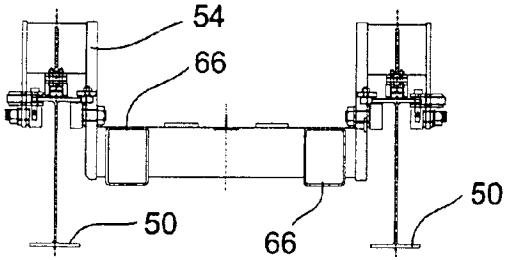
FIG. 6 is a sectional view taken along section line 66 of FIG. 3.

FIG. 6 illustrates a sectional view taken along section line 6—6 of FIG. 3 showing the transport carriage 54 riding on the I-beams of the frame 50.

The transport carriage 54 includes a blowout preventer cradle having a pair of posts 66 that move radially with respect to the transport carriage 54 and the transport skid assembly 42. The cradle moves in the directions shown by arrow 64 in FIG. 3. The posts 66 are moved with respect to the transport carriage 54 by a pair of hydraulic cylinders 68. The cradle and posts 66 pivot about pivot pins 48. Actuation and extension of the hydraulic cylinders 68 results in radial movement of the cradle. Accordingly, the blowout preventer 36 will be moved between a horizontal transport position and a vertical use position.

Figure 4:
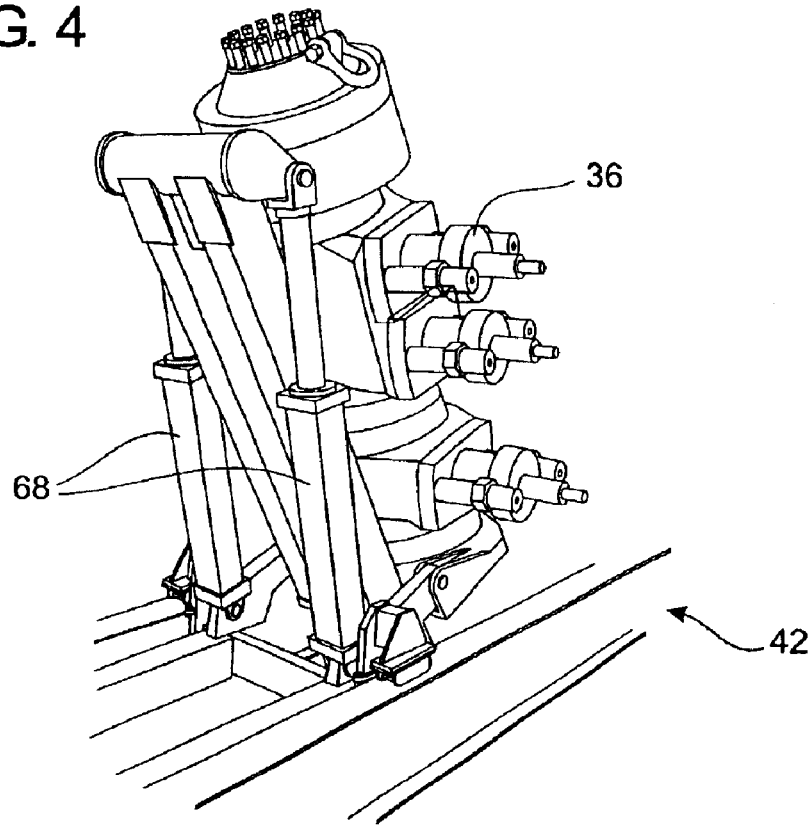
FIG. 4 illustrates the blowout preventer transportation skid assembly shown in FIGS. 2 and 3 with hydraulic cylinders partially extended in FIG. 4 and the hydraulic cylinders fully extended in FIG. 5 so that the blowout preventer is in the vertical, fully upright position.
Figure 5:
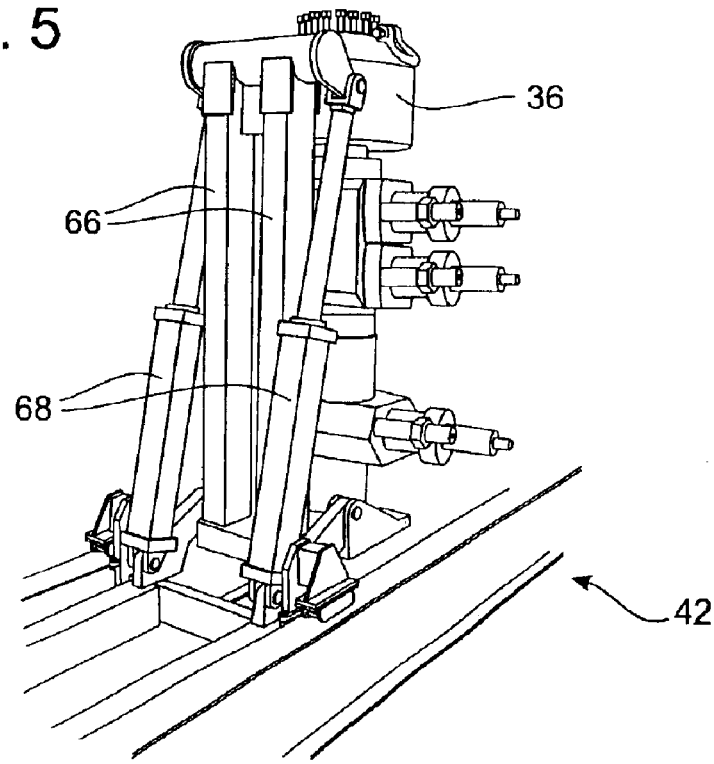

FIGS. 4 and 5 illustrate movement of the cradle. FIG. 4 illustrates the hydraulic cylinders 68 partially extended while FIG. 5 illustrates the hydraulic cylinders 68 fully extended so that the blowout preventer 36 is in the vertical, fully upright position parallel to the well head.

Once the blowout preventer 36 is in the vertical position, various hydraulic hoses extending from the hydraulic power unit and accumulator may be connected to the blowout preventer 36 (not shown in FIGS. 4 and 5). Once the hoses have been connected, the blowout preventer can be fully tested at this stage. Alternatively, the hoses can be connected prior to the blowout preventer being raised from the horizontal position.

Thereafter, the transport carriage 54 can be moved by the drive assembly with respect to the transport skid assembly 42 so that the upright blow out preventer 36 is in line with center line 14 shown in FIG. 1 beneath the drillers cabin.

Figure 7:
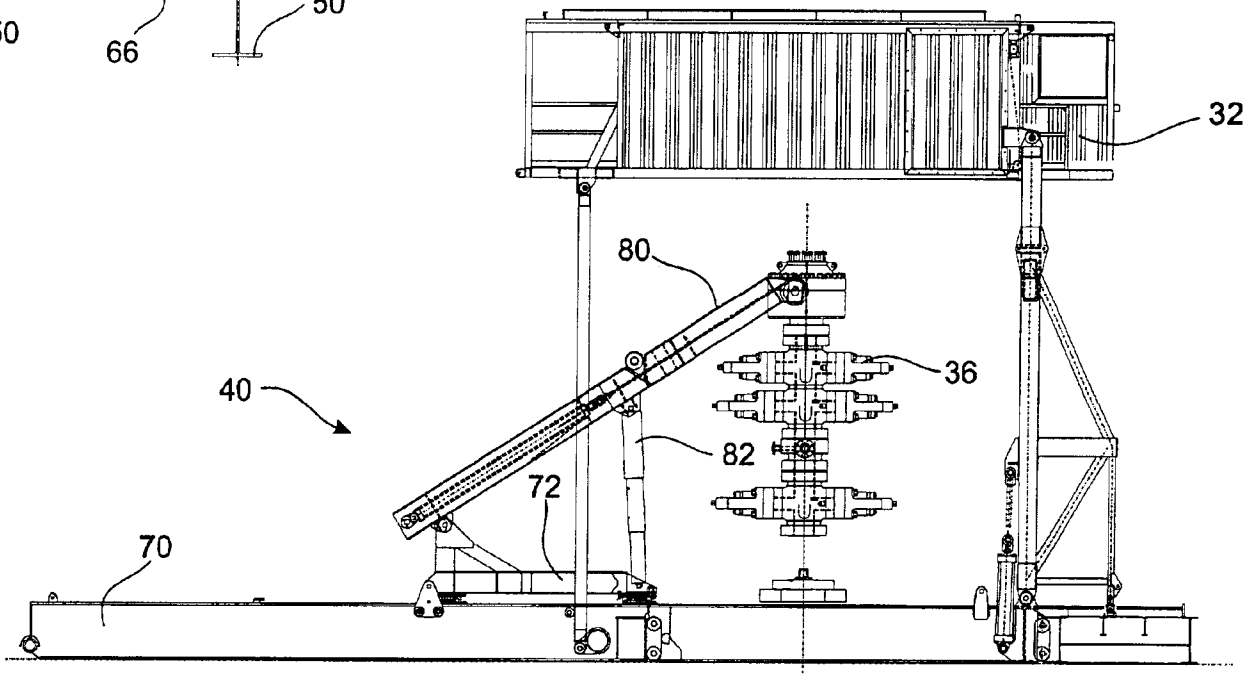
FIG. 7 and FIG. 8 illustrate a boomer assembly of the blowout preventer transportation and installation system of the present invention.
Figure 8:
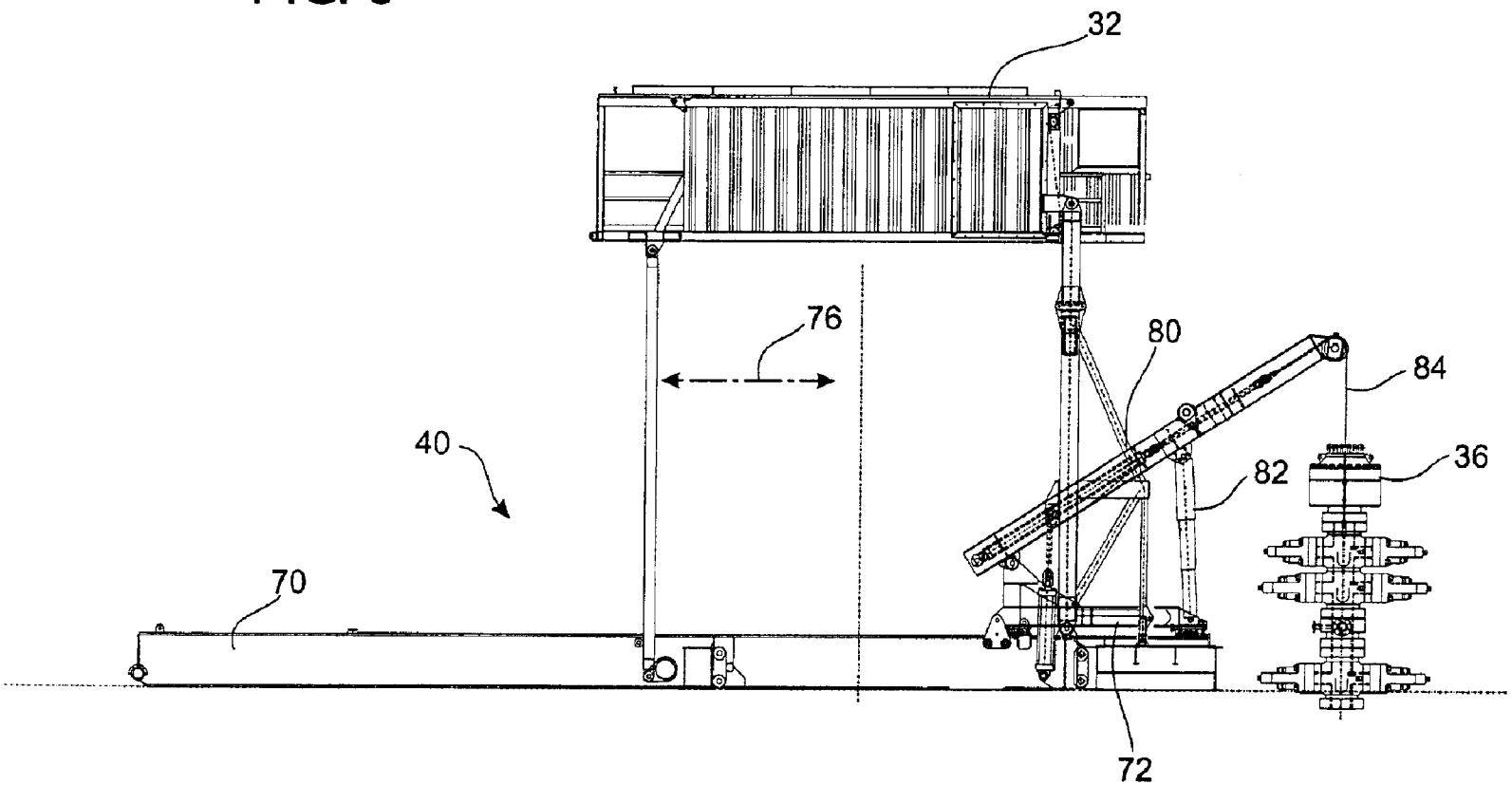

FIGS. 7 and 8 illustrate the movement of the blowout preventer 36 from the transportation skid assembly 42 to a position over the wellhead.

Figure 9:
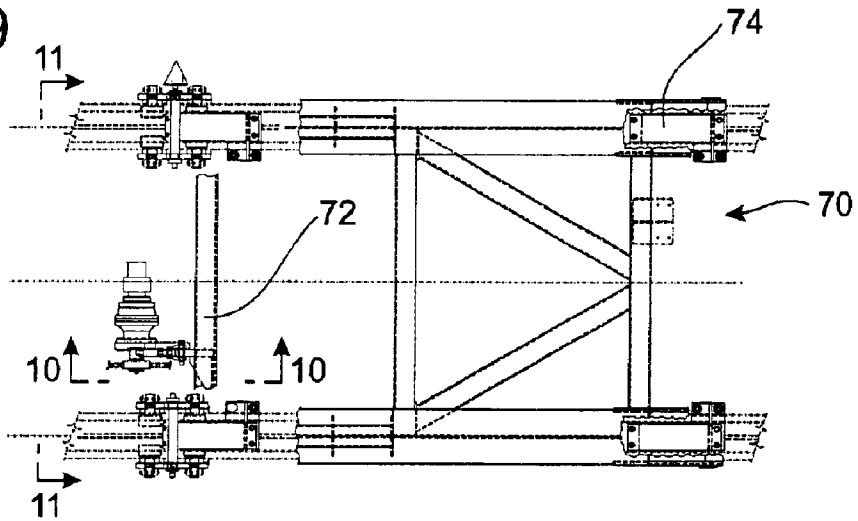
FIG. 9 illustrates a partial view of the boomer assembly shown in FIGS. 7 and 8.

The boomer assembly 40 includes a carriage frame 70 having a pair of I beams parallel to each other. FIG. 9 is a top view of a carriage frame 70 with portions cut away for clarity.

Figure 10:
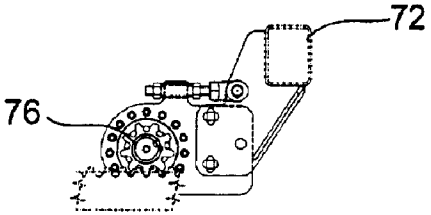
FIG. 10 illustrates a sectional view taken along section line 10—10 of FIG. 9.
Figure 11:
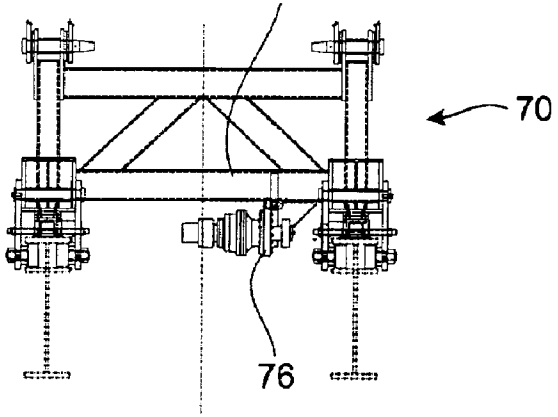
FIG. 11 illustrates a sectional view taken along section line 11—11 of FIG. 9.

The boomer assembly 40 includes a carriage frame 72 that moves along the I beams of the frame 70 in the same or parallel plane. The carriage frame 72 includes a series of rollers 74 that engage the I beams of the frame 70. FIG. 10 is a sectional view taken along section line 10—10 of FIG. 9 while FIG. 11 is a sectional view taken along section line 11—11 of FIG. 9. Carriage frame 72 includes a drive assembly 76 that engages a rack on the frame 70 to move carriage 72 in the directions shown in arrow 76 in FIG. 8.

The carriage frame 72 includes a boom or crane 80 which will be used to raise and lower the blowout preventer 36. The boom has an extending arm that terminates in a retractable or extendable line 84, such as a wireline. The blowout preventer 36 may have an extending ear or ears to connect the line 84 to the blowout preventer. The boom 80 includes a cylinder or cylinders 82 to raise or lower the boom 80 and accordingly, the blowout preventer 36.

The blowout preventer 36 will be moved by the boom 80 along a path shown by dashed line 14 in FIG. 1 until the blowout preventer is over the wellhead. Thereafter, the cylinder 82 will be retracted in order to lower the blowout preventer over the wellhead for attachment.

Figure 12:
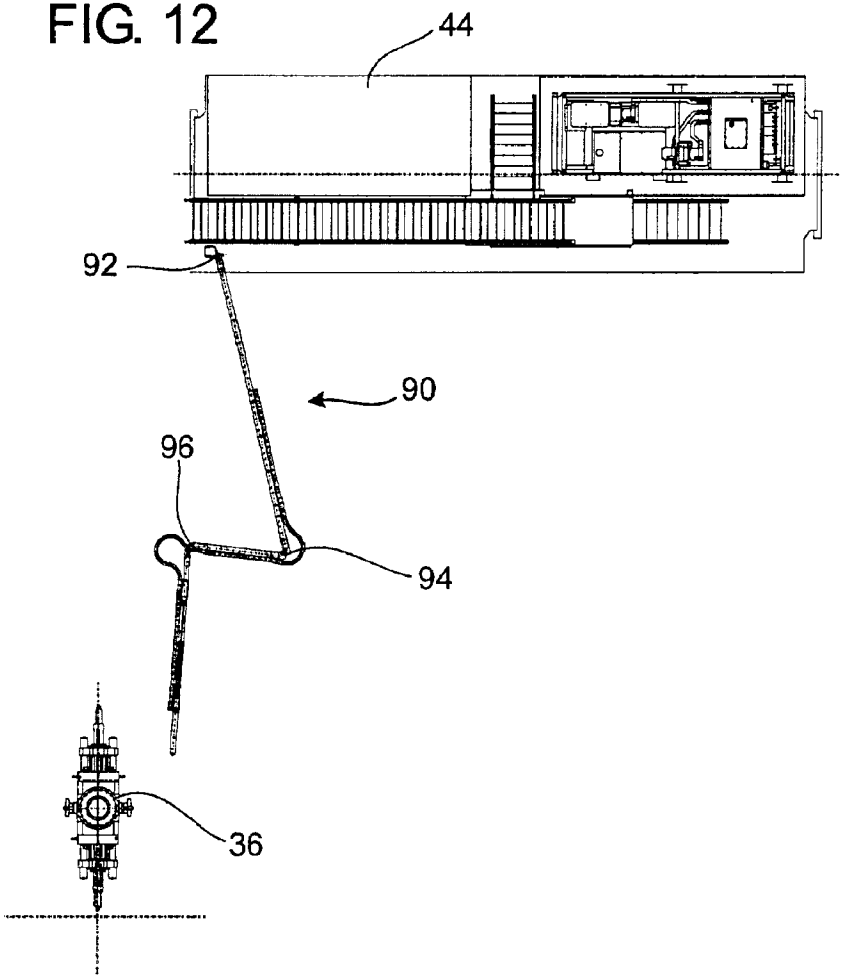
FIG. 12 illustrates a diagrammatic view of an articulating control line support assembly of the present invention.

Once the hoses and lines are connected between the hydraulic power and control unit 44 and the blowout preventer, an articulating control line support assembly 90 moves the hoses along with the blowout preventer as seen in FIG. 12. The assembly 90 is pivoted to the hydraulic power unit 44 by hinges 92 and is articulated at joint 94 and joint 96. Accordingly, the hoses will remain connected during the movement of the blowout preventer.

The reverse order of steps will be performed to remove the blowout preventer from the wellhead for transportation.

Whereas, the present invention has been described in relation to the drawings attached hereto, it should be understood that other and further modifications, apart from those shown or suggested herein, may be made within the spirit and scope of this invention.

What is claimed is:

1. A process for transportation and installation of a blowout preventer for a drilling rig, which process comprises:

raising a blowout preventer on a blowout preventer transportation skid assembly from a horizontal transport position to a vertical position;

connecting hose lines from a hydraulic power unit to said blowout preventer;

moving a transport carriage on said skid assembly in order to move said blowout preventer with respect to said skid assembly;

lifting said blowout preventer from said transport carriage with a crane mounted on a carriage frame of a boomer assembly;

moving said blowout preventer over a well center by moving said carriage frame with respect to a boomer assembly frame; and articulating a control line support assembly which supports said hose lines.

2. A process for transportation and installation of a blowout preventer as set forth in claim 1 wherein the steps are performed in reverse order.

3. A process for transportation and installation of a blowout preventer as set forth in claim 1 wherein said hose lines are connected to said blowout preventer prior to raising said blowout preventer from a horizontal transport position.

4. A process for transportation and installation of a blowout preventer as set forth in claim 1 wherein said step of raising said blowout preventer from a horizontal position includes extending a pair of hydraulic cylinders between said transport carriage and said skid assembly.

5. A process for transportation and installation of a blowout preventer as set forth in claim 1 including the additional step of testing said blowout preventer after said step of connecting said hose lines.

6. A process for transportation and installation of a blowout preventer as set forth in claim 1 including the additional initial step of transporting said blowout preventer to a drilling rig site on said skid assembly.

7. A blowout preventer transportation and installation apparatus, which apparatus comprises:

a transportation skid assembly to move said blowout preventer between a horizontal transport position and a vertical position;

a transport carriage on said skid assembly to move said blowout preventer with respect to said skid assembly;

a boomer assembly having a crane mounted on a carriage frame movable on a boomer assembly frame; and a control line support assembly to support hose lines between said blowout preventer and a hydraulic power unit.

8. A handling system for a blowout preventer for a drilling rig as set forth in claim 7 wherein said blowout preventer is moved from horizontal to vertical by a pair of cylinders.

9. A handling system for a blowout preventer as set forth in claim 7 wherein said transport carriage is moved on said skid assembly by a rack and pinion assembly.

10. A handling system for a blowout preventer as set forth in claim 7 wherein said transport carriage engages said skid assembly with rollers.

11. A handling system for a blowout preventer as set forth in claim 7 wherein said boomer assembly has a pair of hoists.

12. A handling system for a blowout preventer as set forth in claim 7 wherein said boomer assembly includes a cylinder to raise said crane.

13. A handling system for a blowout preventer as set forth in claim 7 wherein said transport carriage is perpendicular to said boomer assembly carriage frame.

14. A handling system for a blowout preventer as set forth in claim 7 wherein said control line support assembly is supported from said hydraulic power unit and is articulated in at least two places.

* * * * *